United States Patent [19]

Jagst

[11] Patent Number: 4,797,980

[45] Date of Patent: Jan. 17, 1989

[54] WASTE SEPARATOR FOR A CARD

[75] Inventor: Peter Jagst, Möchengladbach, Fed. Rep. of Germany

[73] Assignee: Trützschler GmbH & Co. Kg, Mönchengladbach, Fed. Rep. of Germany

[21] Appl. No.: 67,411

[22] Filed: Jun. 19, 1987

Related U.S. Application Data

[63] Continuation of Ser. No. 688,893, Jan. 4, 1985, abandoned.

[51] Int. Cl.[4] ..... D01G 15/80

[52] U.S. Cl. ..... 19/107; 19/109

[58] Field of Search ..... 19/107, 109

[56] References Cited

U.S. PATENT DOCUMENTS

| | | | |
|---|---|---|---|
| 4,379,357 | 4/1983 | Beneke et al. | 19/107 X |
| 4,400,852 | 8/1983 | Löffler | 19/107 X |
| 4,438,549 | 3/1984 | Silander | 19/107 |

*Primary Examiner*—Louis K. Rimrodt

*Attorney, Agent, or Firm*—Spencer & Frank

[57] ABSTRACT

A card includes a main carding cylinder having a direction of rotation, a doffer cooperating with the main carding cylinder and a waste separator situated above the doffer and adjacent the main carding cylinder. The waste separator includes a knife blade situated close to the main carding cylinder and being oriented in a direction opposite the direction of rotation, a plate situated at a small radial distance from the main carding cylinder and having an edge defining a gap with the knife blade and a casing defining a suction chamber shrouding the gap. The casing and the knife blade are formed of a single-piece component.

8 Claims, 3 Drawing Sheets

WASTE SEPARATOR FOR A CARD

This application is a continuation of application Ser. No. 688,893, filed Jan. 4, 1985, now abandoned.

BACKGROUND OF THE INVENTION

This invention relates to a device for separating waste such as trash, shell fragments or the like in a carding machine or a roller card unit. The device is arranged above the doffer and has a knife blade which is oriented opposite the rotary direction of the main carding cylinder and is at a small distance from the clothing thereof. There is further provided a plate which is at a small radial distance from the cylinder and at a circumferential distance from the knife blade Between the edge of the plate and the knife blade a clearance is defined which is enclosed by a suction chamber.

In known devices of the above type, a profiled body is provided which, at its face oriented forwardly against the rotary direction of the carding cylinder, is bevelled and carries thereon a knife blade whose distance from the clothing of the cylinder is adjustable. A housing portion forms a component of the profiled body and encloses a cylindrical hollow space which functions as a suction chamber. Further, to the free end of the housing part a closure plate is mounted (by means of a screw connection) which extends to the plate and, together with the knife edge, bounds a suction channel which, in turn, adjoins the clearance between the plate and the knife blade. Such an arrangement is disadvantageous in that it has a complex structure.

In conventional constructions where the knife blade and the housing portion (casing) are separate components secured to one another, for example, by screw-connection, it is a further disadvantage that the slender, usually approximately 1 m long knife blade is likely to "flutter" during operation which means that the distance between the knife edge and the delicate cylinder clothing fluctuates. Such phenomenon jeopardizes the cleaning effect of the arrangement and furthermore, risks are high that the excursions of the knife edge during such "flutter" are sufficiently large to touch and damage the clothing.

It is also a disadvantage of the prior art arrangement that when adjustments of the knife blade with respect to the carding cylinder are to be made, two separate settings have to be performed: namely, an adjustment of the knife blade with respect to the casing and the casing ( or other support component) with respect to the carding cylinder.

SUMMARY OF THE INVENTION

It is an object of the invention to provide an improved waste separator of simple construction.

This object and others to become apparent as the specification progresses, are accomplished by the invention, according to which, briefly stated, the knife blade and a casing defining the suction chamber are formed by a single component.

By virtue of the one-piece construction of the knife blade and the casing which defines the suction chamber, a structurally very simple device is obtained which has, in particular, significant manufacturing advantages. Also, the two functions, namely, cutting and removal by suction are combined with one another and are effected in a very simple manner.

A one-piece construction of the knife blade and the casing has the significant advantage that the stiffness of the knife blade is substantially increased and thus the earlier-noted disadvantageous "flutter" phenomena can no longer occur and consequently, the distance of the knife edge from the cylinder clothing is satisfactorily stabilized.

It is a further advantage of the invention that is a positional adjustment of the knife blade has to be made, only a single component, that is, the one-piece casing/-knife structure has to be set, for example, by turning the one-piece structure about a horizontal axis. The earlier-noted need for setting two components is therefore eliminated.

According to a further advantageous feature of the invention, the casing defining the suction chamber is formed of a bent sheet metal piece, whose adjoining longitudinal edges define an open throughgoing clearance and one of the longitudinal edges forms a knife blade. Expediently, the knife blade is at a right angle to the adjoining wall surface. By virtue of such an L-shaped configuration a greater resistance against buckling in the radial direction is provided.

According to a further advantageous feature of the invention, the cross section of the suction chamber is rectangular or quadratic. According to a further feature of the invention, the casing defining the suction chamber is a tube which may be a commercially available element and in which a throughgoing clearance is provided by simply cutting through the tube wall. It is a further feature of the invention to provide an adjustability of the distance of the suction chamber from the clothing of the main carding cylinder.

DESCRIPTION OF THE PREFERRED EMBODIMENTS

Figure 1:
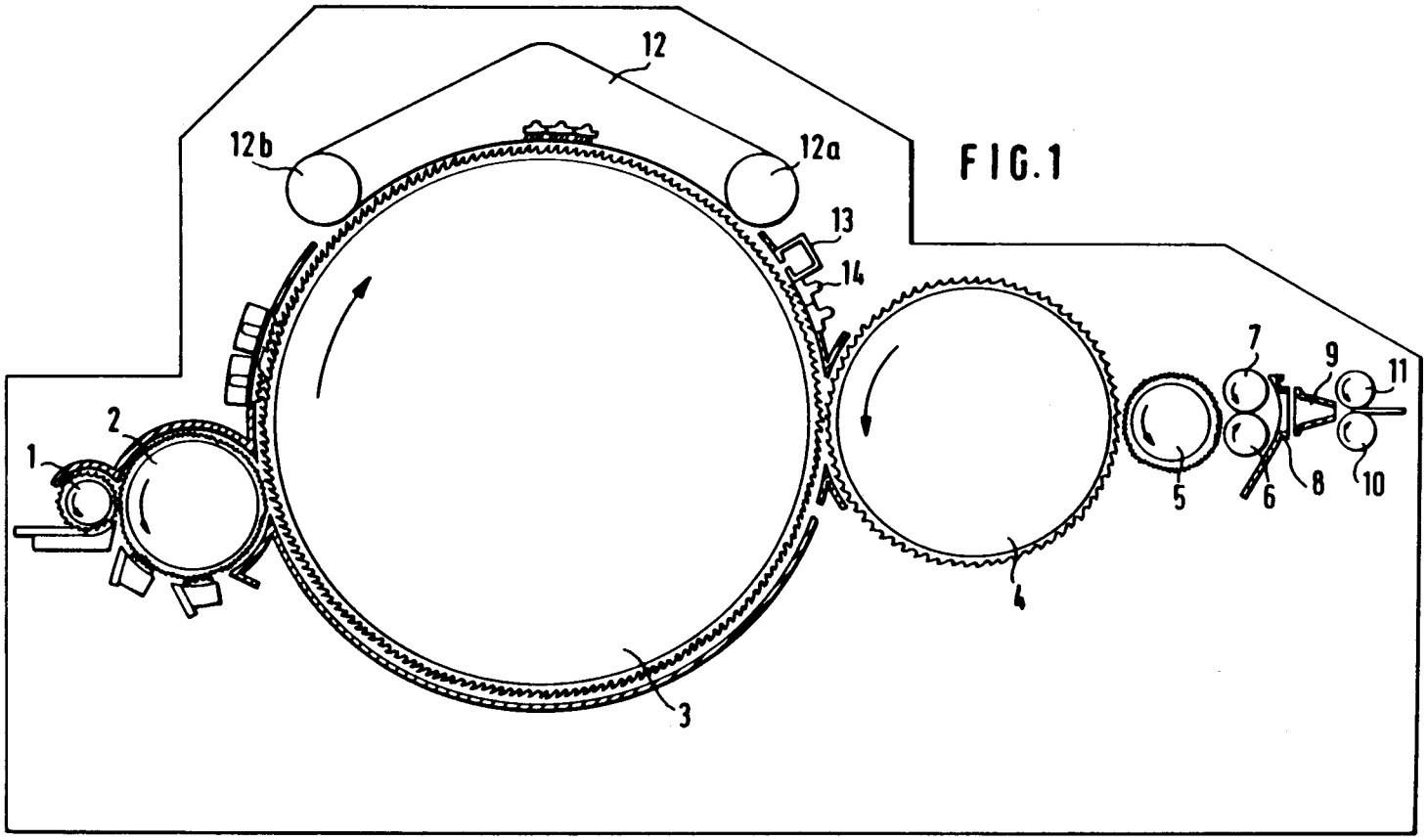
FIG. 1 is a schematic side elevational view of a card incorporating a preferred embodiment of the invention.

Turning to FIG. 1, there is schematically illustrated a carding machine having a feed roller 1, a licker-in 2, a main carding cylinder 3, a doffer 4, a stripper roller 5, crushing rollers 6 and 7, a web guiding element 8, a trumpet 9, calender rollers 10 and 11, as well as traveling flats 12 having a frontal end roller **12*a* and a rear end roller 12*b*. Between the doffer 4 and the frontal end roller 12*a* there is provided a device 13 for separating waste, structured according to the invention. Downstream of the device 13, as viewed in the direction of rotation of the carding cylinder 3, stationary carding elements 14** are provided.

Figure 2:
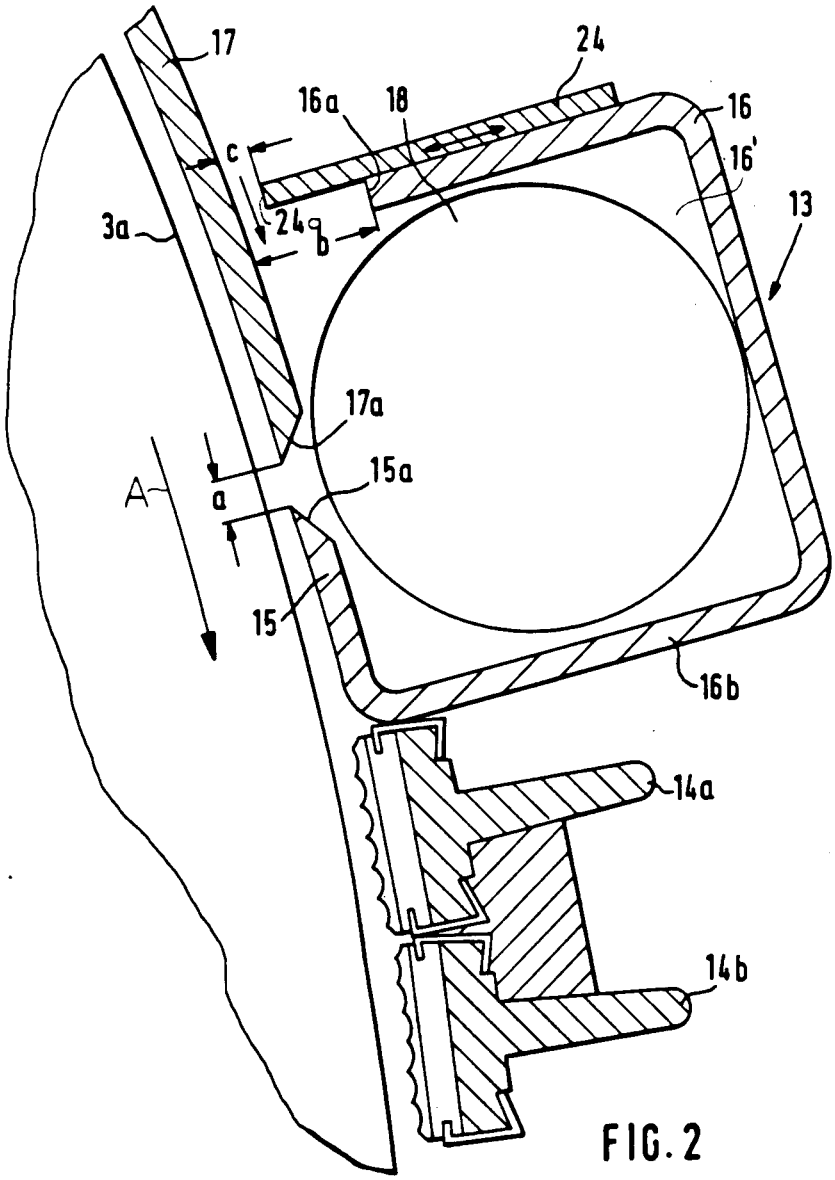
FIG. 2 is an enlarged sectional side elevational view of a detail of FIG. 1.
Figure 3:
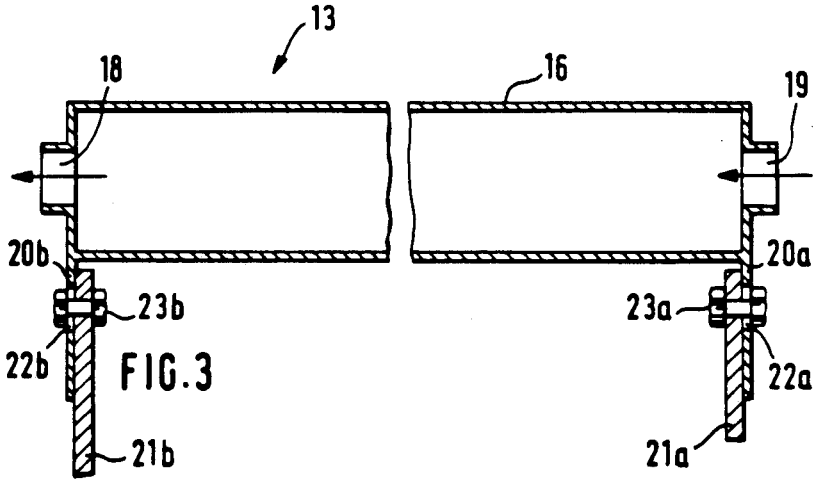
FIG. 3 is a sectional plan view of the construction shown in FIG. 2.

FIG. 2 shows the separator device 13 in greater detail. The device 13 has a knife blade 15 and a bent sheet metal casing 16 constituting a suction chamber 16'. The two components 15 and 16 are combined to constitute a unitary, one-piece structure. The knife blade 15 is situated at a small distance from the clothing **3*a* of the carding cylinder 3 and is oriented against the rotary direction A thereof. The knife blade 15 is situated at a circumferential distance a of, for example, 3–5 mm from an edge 17*a* of a plate 17 which is arranged upstream of the knife blade 15 and which is at a small radial distance from the clothing 3*a* of the carding cylinder 3. The casing 16 and thus the suction chamber 16' covers the clearance a between the plate 17 and the knife blade 15. The casing 16 is formed of a bent sheet metal component having opposite longitudinal edges 16***a* and 15*a* spaced from another. The edge 16*a* is at a distance b from the plate 17. The longitudinal edge 15*a* is sharpened to constitute the knife blade 15. The knife blade 15 is arranged at 90° to the adjoining wall surface 16*b* of the casing 16. The cross-sectional outline of the suction chamber 16' has a generally square shape. Downstream of the device 13 as viewed in the direction of rotation of the cylinder 3 there are arranged fixed carding elements 14*a* and 14*b*. Also referring to FIG. 3, at one end of the casing 16 there is provided an outlet opening 18 which is coupled to a vacuum source, not shown. The waste enters the suction chamber 16' between the bevelled edge 17*a* of the plate 17 and the knife blade 15 and is entrained therefrom by suction through the outlet opening 18. At the other end of the suction chamber 16', in alignment with the outlet opening 18, there is situated an inlet opening 19 for aspirating ambient air. On the side of the casing 16 which includes the terminal edge 16*a*, there is mounted for sliding motion a regulating plate 24, whose edge 24*a* defines a variable clearance c along the length of the suction chamber 16' from the inlet 19 to the outlet 18. The adjustable clearance c provides for a lateral admission of external air into the suction chamber 16' to vary the flow characteristics therein.

The device 13 is mounted on the carding machine by lateral projections 20*a* and 20*b* on the extension arcs 21*a* and 21*b* which are continuations of the flexible arcs. The projections 20*a* and 20*b* have longitudinal slots 22*a* and 22*b* through which pass securing screws provided with nuts 23*a* and 23*b*. In this manner, the distance of the device 13, that is, the distance of the casing 16, with the knife blade 15, from the carding cylinder 3 may be varied.

Figure 4:
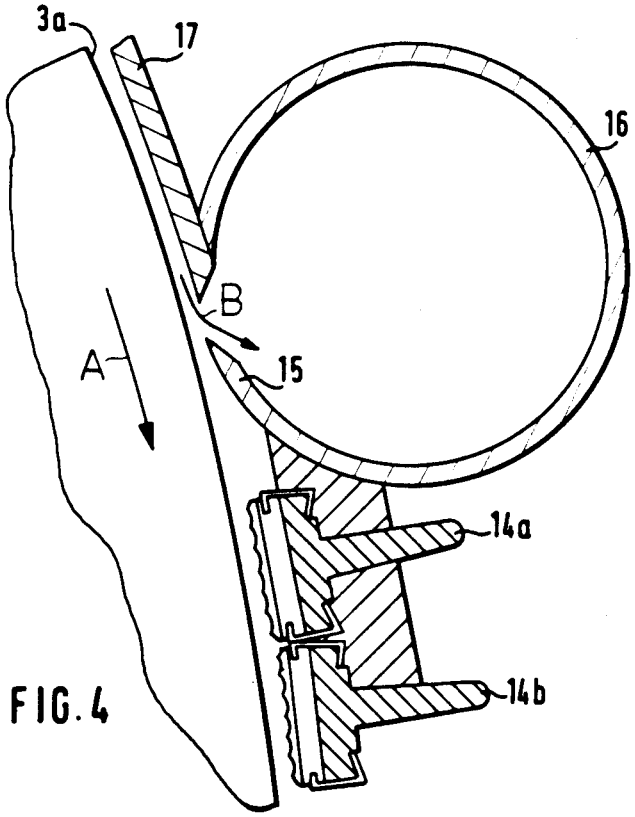
FIG. 4 is a sectional side elevational view of another preferred embodiment of the invention.

In the embodiment illustrated in FIG. 4, the casing 16, together with the knife blade 15 is constituted by a tube. The inflow of waste into the inside of the suction chamber 16' is designated by an arrow B.

It will be understood that the above description of the present invention is susceptible to various modifications, changes and adaptations, and the same are intended to be comprehended within the meaning and range of equivalents of the appended claims.

What is claimed is:

1. In a card including a main carding cylinder having a direction of rotation, a doffer cooperating with the main carding cylinder and a waste separator situated above the doffer and adjacent the main carding cylinder; the waste separator including a knife blade situated close to the main carding cylinder and being oriented in a direction opposite said direction of rotation, a plate situated at a small radial distance from the main carding cylinder and having an edge defining a gap with the knife blade and a casing defining a suction chamber shrouding said gap; the improvement wherein said casing and said knife blade are formed of a single-piece component.

2. A card as defined in claim 1, wherein said casing is a bent sheet metal member having a longitudinal edge constituting said knife blade.

3. A card as defined in claim 2, wherein said casing has a further longitudinal edge spaced from said knife blade and defining a longitudinal air inlet clearance with said plate; said air inlet clearance being in communication with said suction chamber and being spaced from said gap.

4. A card as defined in claim 3, wherein said clearance has a width; further comprising a regulating plate slidably mounted on said casing at said further longitudinal edge for varying the width of said clearance.

5. A card as defined in claim 1, wherein said casing has two walls joining one another at 90°; said knife blade being formed at one of said walls.

6. A card as defined in claim 1, wherein said casing has a rectangular cross-sectional outline.

7. A card as defined in claim 1, wherein said casing is tubular.

8. A card as defined in claim 1, further comprising means for adjusting the distance of said casing from said main carding cylinder.

* * * * *